US005134819A

United States Patent [19]

Boyack

[11] Patent Number: 5,134,819

[45] Date of Patent: Aug. 4, 1992

[54] BENDABLE SWIMMING POOL COPING

[76] Inventor: John D. Boyack, Rte. 17, Box 515, Tyler, Tex. 75704

[21] Appl. No.: 680,586

[22] Filed: Apr. 4, 1991

[51] Int. Cl.[5] ..... E04H 4/00

[52] U.S. Cl. ..... 52/169.7; 4/506; 52/102

[58] Field of Search ..... 52/169.7, 287, 288, 52/108, 309.1, 716, 273, 102; 4/506

[56] References Cited

U.S. PATENT DOCUMENTS

| | | | |
|---|---|---|---|
| Re. 27, 669 | 6/1973 | Rozanski | 52/169.7 X |
| 1,011,642 | 12/1911 | Patterson . | |
| 3,335,429 | 8/1967 | Arp | 52/169.7 X |
| 3,371,455 | 3/1968 | Fox | 4/506 X |
| 3,387,419 | 6/1968 | Kamberg et al. | 52/716 |
| 3,468,088 | 9/1969 | Miller | 52/102 X |
| 3,512,326 | 5/1970 | Greene | 51/169.7 X |
| 3,706,173 | 12/1972 | Taylor . | |
| 3,750,197 | 8/1973 | Weir et al. | 52/169.7 |
| 3,831,990 | 8/1974 | Singh et al. . | |
| 3,835,481 | 9/1974 | Engelhard et al. | 52/169.7 |
| 3,959,830 | 6/1976 | van den Broek . | |

*Primary Examiner*—Richard E. Chilcot, Jr.
*Assistant Examiner*—Robert J. Canfield
*Attorney, Agent, or Firm*—Eugene Stephens & Associates

[57] ABSTRACT

A swimming pool coping that can be used for covering a top edge of curved swimming pool walls includes an integrally formed body having a hollow nose-shaped portion and a mounting seat portion. The hollow nose-shaped portion has a rounded profile with top and bottom portions that are connected by a web. A notch-shaped relief joint interrupts the bottom portion of the rounded profile in a position that contracts in response to bending of the coping body in either of two directions to match concave and convex curvatures of swimming pool walls. The rounded profile projects from the web through a distance that is decreased by the contraction of the relief joint so that the coping exhibits a similar appearance while matching either concave or convex curvatures of the pool walls.

28 Claims, 2 Drawing Sheets

BENDABLE SWIMMING POOL COPING

BACKGROUND

Coping is used around the top edge of swimming pool walls to provide an attractive interface between the pool walls and a surrounding deck. Materials from which swimming pool copings are made include tile, aluminum, and resin. The aluminum and resin copings can also be shaped to provide channels for supporting vinyl liners over structural walls of the pool. However, the resin material is often preferred over the aluminum material because paint is easily chipped from the aluminum copings, leaving a permanently marred appearance. In contrast, the resin copings resist denting and do not have to be painted.

Nevertheless, it has been necessary to use preformed aluminum coping on curved pool walls because available resin copings cannot be bent to match the desired curvatures. The preformed aluminum copings add considerable inventory to pool manufacturers, because different shaped copings are required for each different curve of the pool walls, including each different length of the same curvature. Attempts to solve this problem have included applying heat to the resin copings to encourage them to bend, but the results have not been satisfactory. The heated resin coatings tend to kink when bent.

SUMMARY OF THE INVENTION

My invention is first to provide a suitable resin coping for curved swimming pool walls. The new coping, which can be made of a conventional vinyl-resin such as polyvinyl chloride or "PVC", is rigid yet bendable to match both concave and convex curvatures of swimming pool walls. Nevertheless, the coping provides the same smooth uninterrupted appearance as coping sections that are specially preformed for particular curves.

The resinous material is preferably extruded in the form of an elongated body having a hollow nose-shaped portion, a mounting seat portion, and a neck portion interconnecting the two other portions. The hollow nose portion has a rounded profile with top and bottom portions that are connected by a web. A notch-shaped relief joint interrupts the bottom portion of the rounded profile and extends into the hollow nose portion for assisting the coping body to bend in directions that match desired curvatures of the swimming pool walls. The relief joint interrupting the rounded profile contracts in response to bending of the coping body in either of two directions required to match concave and convex curvatures of the pool walls.

Preferably, the relief joint includes a bottom wall interconnecting two side walls that are moved closer together by the bending of the coping body in opposite directions. Although the relief joint interrupts the rounded profile of the hollow nose portion, the notch is positioned in a portion of the profile that is not readily visible from ordinary positions at which the installed coping can be viewed. In fact, an observer would have to be positioned nearly beneath the coping to take any notice of the relief joint. The rounded profile can also be skewed toward its bottom portion to further obscure the view of the relief joint.

The web interconnecting the top and bottom portions of the rounded profile preferably extends perpendicular to the plane defined by the two directions of bending that match curvatures of swimming pool walls. This orientation of the web minimizes resistance to bending, yet prevents the top and bottom portions of the rounded profile from moving together or apart as a result of the bending. This helps to maintain the coping at an even height above the pool wall to provide a level surface against which the pool deck may be abutted or poured.

The relief joint also preferably extends substantially parallel to the web with a result that the rounded profile projects from the web through a distance that is decreased by the contraction of the relief joint. This has the effect of reducing the resistance of the hollow nose portion to bending; and since the contraction is the same for both bending directions, the coping has a similar appearance about both concave and convex curves of the pool walls.

The neck portion communicates bending moments exerted on the mounting seat portion to the hollow nose portion. The three portions of the coping body can also be used together to form respective walls of a channel for accommodating a liner bead from which a conventional liner is suspended. For example, the neck portion can be used to form a back wall of the channel, and the bottom portion of the rounded profile and a flange member of the mounting seat portion can be used to form respective top and bottom walls of the channel.

Although the invention is mainly directed to the configuration of the hollow nose portion, it is especially advantageous that the integrally formed mounting seat portion can be configured in a wide variety of ways to accommodate different pool wall designs. In addition, although the invention is also directed to providing a suitably bendable resin coping, it is expected that the design fostered by my invention may also be used to similar advantage with other coping materials.

DRAWINGS

DETAILED DESCRIPTION

Figure 1:
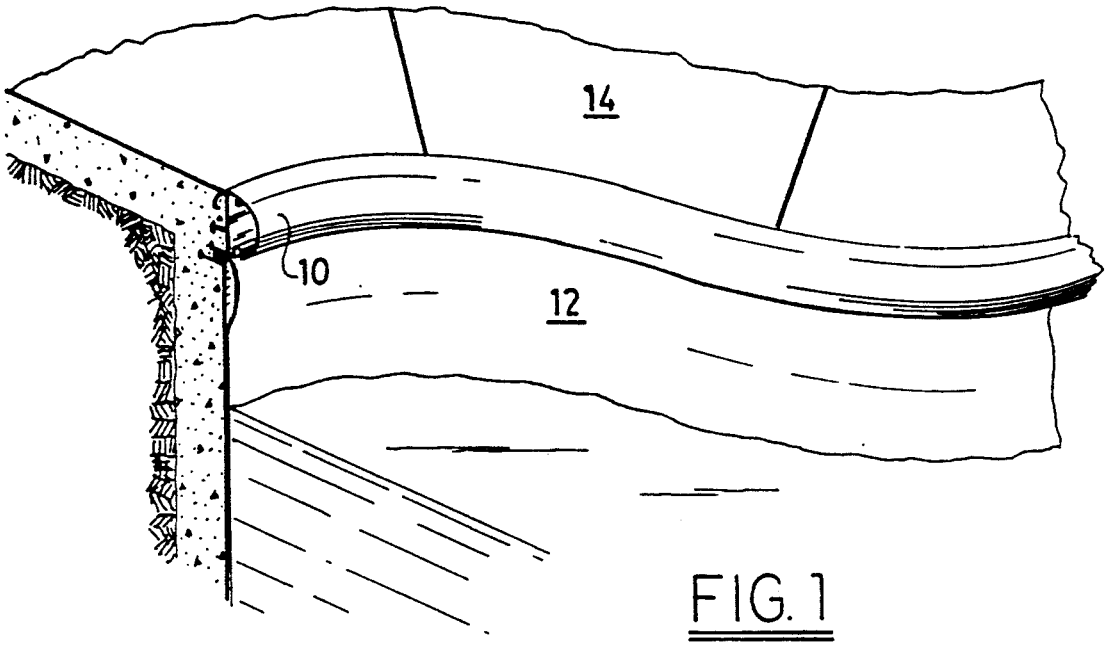
FIG. 1 is a fragmentary perspective view of a swimming pool showing my bendable coping installed on the top edge of a pool wall having both concave and convex curvatures.

My new coping 10 is shown in FIG. 1 on the top edge of curved swimming pool wall 12. The coping 10 is shaped to provide a smooth interface between a concrete deck 14 surrounding the pool and the curved wall 12. To do so, the liner is bent to match both the concave and convex curvatures of the wall 12.

Details of the coping design that make this possible are shown in the remaining drawing FIGS. 2–5. Common to the various embodiments illustrated in these four remaining drawing figures is a hollow nose-shaped portion 20. However, all four embodiments have different mounting seat portions 22, 24, 26, and 28 for attaching the coping to different pool walls. Each of the mounting seat portions is connected to the similar hollow nose-shaped portions 20 by respective neck portions 32, 34, 36, and 38. Bending moments exerted on the mounting seat portions 22, 24, 26, and 28 to match the curvatures of the swimming pool wall 12 are communicated to the hollow nose portions 20 through the respective neck portions 32, 34, 36, and 38 for bending the hollow nose portions to substantially the same curvatures as the mounting seat portions.

The hollow nose portion 20 of each embodiment has a rounded profile 40 with top and bottom portions 42 and 44 that are connected by a web 46. Preferably, the web 46 is planar shaped and extends between the top and bottom portions 42 and 44 of the rounded profile substantially perpendicular to the plane defined by the direction of bending required to match the pool wall curvatures. This minimizes resistance of the web 46 to bending and helps to maintain the top portion 42 of the rounded profile at an even height above the respective mounting seat portions.

A notch-shaped relief joint 50 interrupts the bottom portion 42 of the rounded profile and extends into the hollow nose portion 20 for assisting the coping to bend in the directions required to match the pool wall curvatures. The relief joint 50 interrupts the rounded profile 40 in a position that contracts in response to bending of the coping in either of the two directions that are required to match the concave and convex curvatures of the swimming pool wall.

For example, the relief joint 50 can be made with a bottom wall 52 interconnecting two side walls 54 and 56 that are moved closer together along the rounded profile 40 in response to the bending of the hollow nose portion 20 in either direction. The two side walls 54 and 56 of the relief joint extend into the hollow nose portion 20 substantially parallel to the web 46. Contraction of the relief joint has the effect of decreasing a distance through which the rounded profile 40 projects from the planar web 46. Accordingly, the hollow nose portion 20 assumes a similar appearance while matching either concave and convex curvatures. The decreased distance between the rounded profile 40 and the web 46 also helps to reduce the amount of torque required to bend the hollow nose portion 20. Preferably, the bottom wall 52 and the two side walls 54 and 56 of the relief joint are dimensioned to permit the coping to bend in the opposite directions to radii of curvature as small as one meter.

The relief joint 50 is also positioned in the bottom portion of the rounded profile to help hide the relief joint from ordinary view (i.e., from a perspective at eye level or above). For example, the relief joint is hidden from views outside of the pool. In fact, it would not be possible to obtain a clear view of the relief joint except by looking from nearly under the coping. The relief joint 50 is further hidden from view by shaping the rounded profile 40 with a skew that tends to extend the bottom portion 44 of the rounded profile in a horizontal plane.

The just above-mentioned skew of the rounded profile is also believed to assist movement of the rounded profile in a direction that contracts the relief joint 50. A ridge 58 formed within the hollow nose portion 20 helps to reinforce the hollow nose portion and resist kinking.

Figure 2:
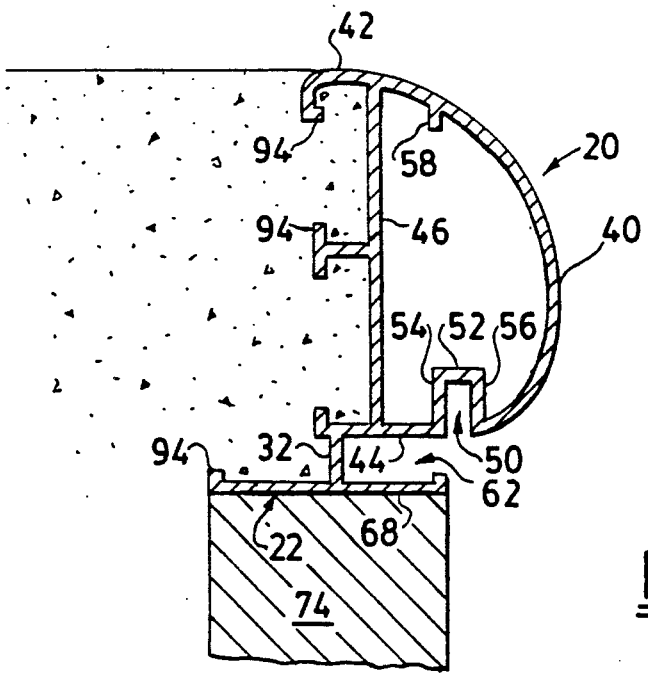
FIG. 2 is a cross-sectional view of my new coping having a hollow nose portion, a liner channel, and a mounting seat portion attached to the top of a pool wall that could be made from a variety of materials.
Figure 3:
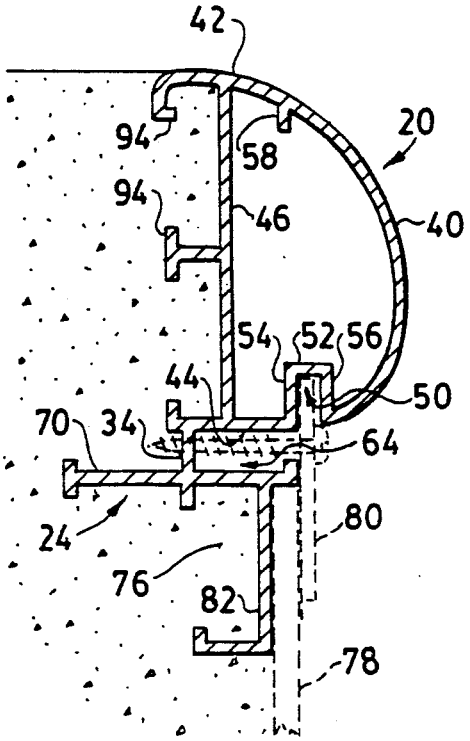
FIG. 3 is a cross-sectional view of a variation of the coping of FIG. 2 showing a similar nose portion and liner channel but a different mounting seat portion that accommodates a form for a poured concrete pool wall.
Figure 4:
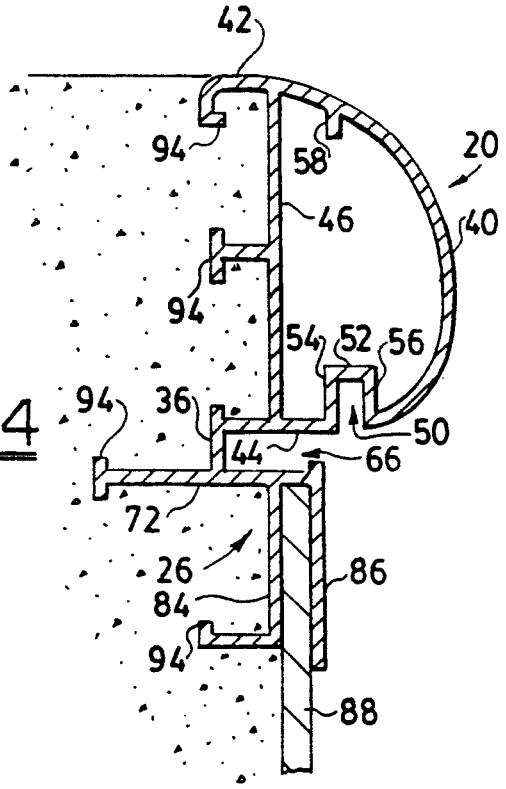
FIG. 4 is a cross-sectional view of another variation of my coping that also shows a similar nose portion and liner channel but shows a mounting seat portion straddling a fiberglass pool wall.
Figure 5:
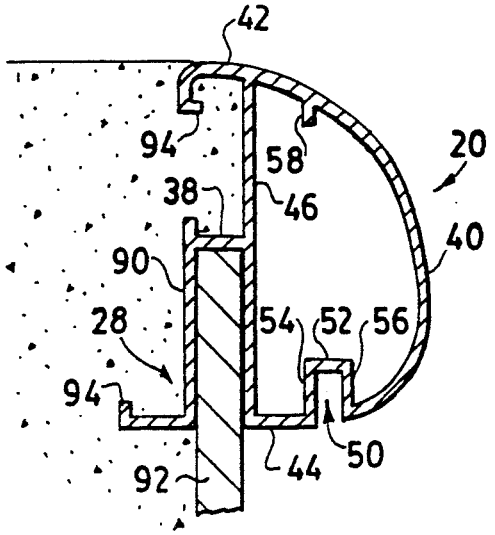
FIG. 5 is yet another cross-sectional view of a coping variation the includes a similar nose portion but no liner channel, and has a mounting seat attached to a hybrid pool wall made of a watertight fiberglass wall permanently bonded against a supporting wall of concrete.

Three of the figures under discussion, namely, FIGS. 2–4, show examples of my coping formed with respective channels 62, 64, and 66 for receiving the bead of a conventional vinyl liner. The bottom portion 44 of the rounded profile of each of the hollow nose portions 20 forms a top wall of the channel. Respective neck portions 32, 34, and 36 form the channel back wall; and flange members 68, 70, and 72 of the respective mounting seat portions form the bottom wall of the channel. The flange members 68, 70, and 72 also form respective rests for mounting the hollow nose portions 20 on the top edge of swimming pool walls.

In FIG. 2, the flange member 68 is set on a top edge of a conventional pool wall 74 composed of a material such as concrete, wood, fiberglass, or metal used in the construction of pool walls. In FIG. 3, the flange member 70 sits on a concrete wall 76 that is made with the aid of a removable form 78. The relief joint or notch 50 is aligned with a front edge of the flange member 70 to receive temporary retainer clips 80 that are screwed into the neck portion 34. The retainer clips 80 hold the removable form 78 in place against an upright extension 82 of the flange member 70.

The coping of FIG. 4 includes a mounting seat portion 26 modified to include two upright extensions 84 and 86 that are designed to capture a fiberglass wall 88 between them. The embodiment shown in FIG. 5 includes an upright extension 90 of the neck portion 38 for trapping a waterproof fiberglass wall 92 against the web 46. However, the embodiment of FIG. 5 uses neck portion 38 as a rest instead of a separate flange member; and for this reason, the neck portion 38 may also be considered a part of the mounting seat portion 28.

Cleats 94 are formed from extensions of the various features of the hollow nose portions and the mounting seat portions of the four embodiments. The cleats 94 help to securely anchor the coping in concrete 96 that is used to form decks surrounding the pool walls.

All four of the illustrated embodiments are also preferably made as extrusions for forming the coping with an elongated body having a substantially invariant cross section along its length to provide uniform resistance against bending. The preferred material out of which the coping is extruded is a vinyl resin such as polyvinyl chloride, or PVC. Other resin materials may also be used to similar advantage, but it is important that the material be rigid enough to support the weight of bathers upon their entering and leaving the pool.

I claim:

1. A swimming pool coping for covering a top edge of curved swimming pool walls comprising:

an integrally formed body having a hollow nose portion and a mounting seat portion;

said hollow nose portion having a rounded profile with top and bottom portions connected by a web; and a notch-shaped relief joint interrupting said bottom portion of the rounded profile and extending into said hollow nose portion for assisting said body to bend in directions that match curvatures of the swimming pool walls.

2. The coping of claim 1 in which said relief joint extends into said hollow nose portion substantially parallel to said web.

3. The coping of claim 2 in which said relief joint includes two side walls that are moved closer together by the bending of said body in either direction to match both concave and convex curvatures of the swimming pool walls.

4. The coping of claim 3 in which said relief joint includes a bottom wall interconnecting said two side walls within said hollow nose portion.

5. The coping of claim 4 in which said relief joint is dimensioned to permit said body to bend in the opposite directions to radii of curvature as small as one meter.

6. The coping of claim 1 in which said body is formed with a substantially invariant cross section along its length to provide uniform resistance against bending along the body length.

7. The coping of claim 6 in which said hollow nose portion and said mounting seat portion are interconnected so that a bending moment exerted on said mounting seat portion is communicated to said hollow nose portion for bending said hollow nose portion together with said mounting seat portion.

8. The coping of claim 7 in which said web extends substantially perpendicular to the plane defined by the directions of bending that match curvatures of the swimming pool wall.

9. The coping of claim 8 in which said rounded profile is skewed toward its bottom portion to help hide said relief joint from ordinary view.

10. A coping for use on swimming pool walls having concave and convex curvatures comprising:

an extruded body having a substantially invariant cross section along its length;

said cross section includes a hollow nose-shaped portion and a mounting seat portion interconnected by a neck portion;

said hollow nose-shaped portion having a rounded profile with top and bottom portions that are connected by a web; and a relief joint interrupting said rounded profile in a position that contracts in response to bending of said body in either of two directions to match the concave and convex curvatures of the swimming pool walls.

11. The coping of claim 10 in which said web extends between said top and bottom portions of the rounded profile substantially perpendicular to the plane defined by the bending that match the curvatures of the swimming pool walls.

12. The coping of claim 11 in which said rounded profile projects from said web through a distance that is decreased by the contraction of said relief joint.

13. The coping of claim 12 in which said relief joint includes two side walls that are moved closer together by the bending of said body in either direction to match the concave and convex curvatures of the swimming pool walls.

14. The coping of claim 13 in which said relief joint includes a bottom wall interconnecting said two side walls within said hollow nose portion.

15. The coping of claim 14 in which said relief joint is dimensioned to permit said body to bend in the opposite directions to radii of curvature as small as one meter.

16. The coping of claim 12 in which said neck portion communicates a bending moment exerted on said mounting seat portion to said hollow nose portion for bending said hollow nose portion together with said mounting seat portion.

17. The coping of claim 16 in which said neck portion extends substantially parallel to said web forming a back wall of a channel for supporting a swimming pool liner from a beaded edge of the liner.

18. The coping of claim 17 in which said seat portion includes a flange member extending substantially perpendicular to said web, forming a bottom wall of said liner channel, and providing a rest for mounting said hollow nose portion on a top edge of the swimming pool walls.

19. The coping of claim 18 in which said relief joint is aligned with a front of said flange member to receive temporary retainer clips for attaching the coping to a removable concrete form.

20. A coping for forming a top of a swimming pool wall and an inner side of a deck surrounding the pool walls comprising:

a hollow nose-shaped part having a rounded profile that joins the deck to the swimming pool wall;

a web interconnecting top and bottom portions of said rounded profile;

cleats projecting from a back of said web for attaching said hollow nose-shaped part to the deck;

a mounting seat part for attaching said hollow nose-shaped part to the swimming pool wall;

a neck connecting said mounting seat part to said hollow nose-shaped part for communicating a bending moment exerted on said mounting seat part to said hollow nose-shaped part; and a notch formed in said rounded profile in a position at which said notch is contracted by bending of said hollow nose-shaped part to match both concave and convex curvatures of the swimming pool walls, wherein said rounded profile projects from said web through a distance that is decreased by the contraction of said notch to provide a similar appearance in matching the concave and convex curvatures.

21. The coping of claim 20 in which said notch extends into said bottom portion of the rounded profile to help hide said notch from ordinary view.

22. The coping of claim 21 in which said rounded profile is skewed toward its bottom portion to further help hide said notch from ordinary view and to encourage movement of said rounded profile in a direction that contracts said notch.

23. The coping of claim 22 in which a ridge is formed within said hollow nose part near said top portion of the rounded profile to reinforce said hollow nose part and to further encourage movement of said rounded profile in a direction that contracts said notch.

24. The coping of claim 21 in which said web is planar and extends perpendicular to the plane defined by the directions of bending that match curvatures of the swimming pool walls.

25. The coping of claim 24 in which said notch extends into said hollow nose part substantially parallel to said web.

26. The coping of claim 25 in which said notch includes two side walls that are moved closer together by the bending of said body in either direction to match the concave and convex curvatures of the swimming pool walls.

27. The coping of claim 21 in which said hollow nose-shaped part, said web, said cleats, said mounting seat part, said neck, and said notch are formed as an integral body that has a substantially invariant cross section along its length.

28. The coping of claim 27 in which said integral body is formed as an extrusion of resin material having sufficient rigidity to support the weight of bathers without significantly deforming.

* * * * *